US006276623B1

(12) United States Patent
Williams

(10) Patent No.: US 6,276,623 B1
(45) Date of Patent: Aug. 21, 2001

(54) SOLDER SUPPORT AND DISPENSING DEVICE

(76) Inventor: Darryl E. Williams, 4130 SW. 117th Ave. PMB #243, Beaverton, OR (US) 97005-8999

( * ) Notice: Subject to any disclaimer, the term of this patent is extended or adjusted under 35 U.S.C. 154(b) by 0 days.

(21) Appl. No.: 09/607,465

(22) Filed: Jun. 30, 2000

(51) Int. Cl.[7] ..... B65H 51/015

(52) U.S. Cl. ..... 242/171; 242/588.6; 242/129; 206/395; 206/409; 206/416

(58) Field of Search ..... 242/128, 129, 242/129.5, 129.7, 129.71, 129.72, 170, 171, 564.3, 566, 579, 587, 587.1, 587.2, 588.3, 588.6; 206/395, 403, 404, 405, 408, 409, 413, 414, 415, 416

(56) References Cited

U.S. PATENT DOCUMENTS

| | | | | |
|---|---|---|---|---|
| D. 347,950 | | 6/1994 | Cisero . | |
| 1,826,084 | * | 10/1931 | Mohr | 206/409 X |
| 2,180,858 | * | 11/1939 | Bedell | 206/408 X |
| 2,930,541 | | 3/1960 | Crum . | |
| 3,150,769 | * | 9/1964 | Cohn | 242/129 X |
| 3,321,151 | | 5/1967 | Maguire . | |
| 3,693,784 | * | 9/1972 | Holmes | 206/409 |
| 3,982,712 | * | 9/1976 | Bassett | 242/129 |
| 4,019,636 | * | 4/1977 | Wise | 206/409 X |
| 4,217,984 | * | 8/1980 | Magnuson | 206/403 |
| 4,657,207 | | 4/1987 | Colbert . | |
| 4,899,945 | | 2/1990 | Jones . | |
| 5,465,917 | | 11/1995 | Kosch . | |
| 5,704,479 | * | 1/1998 | Barnett et al. | 206/409 X |
| 5,826,817 | * | 10/1998 | Selby | 242/588.6 |
| 6,003,667 | * | 12/1999 | Barnett et al. | 206/409 X |

* cited by examiner

*Primary Examiner*—William A. Rivera

(57) ABSTRACT

A solder support and dispensing device for preventing the jamming of solder during the dispensing thereof. The solder support and dispensing device includes a base member having an open top, a first end wall, side walls, a bottom wall, and an open second end; and also includes a spool support member being removably suspended within the base member for supporting a spool carrying continuous solder; and further includes a solder feeding member being securely attached to the bottom wall and extending upwardly therefrom and being disposed at the open second end of the base member with the solder feeding member having a first end and also having a hole extending therethrough near the first end thereof; and also includes a flexible tubular solder guide member having an open first end and an enlarged end portion being securely extending through the hole in the solder feeding member with the tubular solder guide member also having an open second end which is adapted to receive solder therethrough and with the tubular solder guide member being adapted to prevent jamming of the solder during the dispensing thereof.

10 Claims, 2 Drawing Sheets

SOLDER SUPPORT AND DISPENSING DEVICE

BACKGROUND OF THE INVENTION

1. Field of the Invention

The present invention relates to a jam proof solder dispenser and more particularly pertains to a new solder support and dispensing device for preventing the jamming of solder during the dispensing thereof.

2. Description of the Prior Art

The use of a jam proof solder dispenser is known in the prior art. More specifically, a jam proof solder dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,465,917; U.S. Pat. No. 4,657,204; U.S. Pat. No. 4,899,945; U.S. Pat. No. Des. 347,950; U.S. Pat. No. 3,930,541; and U.S. Pat. No. 3,321,151.

While these devices fulfill their respective, particular objectives and requirements, the aforementioned patents do not disclose a new solder support and dispensing device. The inventive device includes a base member having an open top, a first end wall, side walls, a bottom wall, and an open second end; and also includes a spool support member being removably suspended within the base member for supporting a spool carrying continuous solder; and further includes a solder feeding member being securely attached to the bottom wall and extending upwardly therefrom and being disposed at the open second end of the base member with the solder feeding member having a first end and also having a hole extending therethrough near the first end thereof; and also includes a flexible tubular solder guide member having an open first end securely extending through the hole in the solder feeding member with the tubular solder guide member also having an open second end which is adapted to receive solder therethrough and with the tubular solder guide member being adapted to prevent jamming of the solder during the dispensing thereof.

In these respects, the solder support and dispensing device according to the present invention substantially departs from the conventional concepts and designs of the prior art, and in so doing provides an apparatus primarily developed for the purpose of preventing the jamming of solder during the dispensing thereof.

SUMMARY OF THE INVENTION

In view of the foregoing disadvantages inherent in the known types of jam proof solder dispenser now present in the prior art, the present invention provides a new solder support and dispensing device construction wherein the same can be utilized for preventing the jamming of solder during the dispensing thereof.

The general purpose of the present invention, which will be described subsequently in greater detail, is to provide a new solder support and dispensing device which has many of the advantages of the jam proof solder dispenser mentioned heretofore and many novel features that result in a new solder support and dispensing device which is not anticipated, rendered obvious, suggested, or even implied by any of the prior art jam proof solder dispenser, either alone or in any combination thereof.

To attain this, the present invention generally comprises a base member having an open top, a first end wall, side walls, a bottom wall, and an open second end; and also includes a spool support member being removably suspended within the base member for supporting a spool carrying continuous solder; and further includes a solder feeding member being securely attached to the bottom wall and extending upwardly therefrom and being disposed at the open second end of the base member with the solder feeding member having a first end and also having a hole extending therethrough near the first end thereof; and also includes a flexible tubular solder guide member having an open first end securely extending through the hole in the solder feeding member with the tubular solder guide member also having an open second end which is adapted to receive solder therethrough and with the tubular solder guide member being adapted to prevent jamming of the solder during the dispensing thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new solder support and dispensing device which has many of the advantages of the jam proof solder dispenser mentioned heretofore and many novel features that result in a new solder support and dispensing device which is not anticipated, rendered obvious, suggested, or even implied by any of the prior art jam proof solder dispenser, either alone or in any combination thereof.

It is another object of the present invention to provide a new solder support and dispensing device which may be easily and efficiently manufactured and marketed.

It is a further object of the present invention to provide a new solder support and dispensing device which is of a durable and reliable construction.

An even further object of the present invention is to provide a new solder support and dispensing device which is susceptible of a low cost of manufacture with regard to both materials and labor, and which accordingly is then susceptible of low prices of sale to the consuming public, thereby making such solder support and dispensing device economically available to the buying public.

Still yet another object of the present invention is to provide a new solder support and dispensing device which provides in the apparatuses and methods of the prior art some of the advantages thereof, while simultaneously overcoming some of the disadvantages normally associated therewith.

Still another object of the present invention is to provide a new solder support and dispensing device for preventing the jamming of solder during the dispensing thereof.

Yet another object of the present invention is to provide a new solder support and dispensing device which includes a base member having an open top, a first end wall, side walls, a bottom wall, and an open second end; and also includes a spool support member being removably suspended within the base member for supporting a spool carrying continuous solder; and further includes a solder feeding member being securely attached to the bottom wall and extending upwardly therefrom and being disposed at the open second end of the base member with the solder feeding member having a first end and also having a hole extending therethrough near the first end thereof; and also includes a flexible tubular solder guide member having an open first end securely extending through the hole in the solder feeding member with the tubular solder guide member also having an open second end which is adapted to receive solder therethrough and with the tubular solder guide member being adapted to prevent jamming of the solder during the dispensing thereof.

Still yet another object of the present invention is to provide a new solder support and dispensing device that saves the user substantial time for not having to undo solder which is jammed.

Even still another object of the present invention is to provide a new solder support and dispensing device that is compact and easy and convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
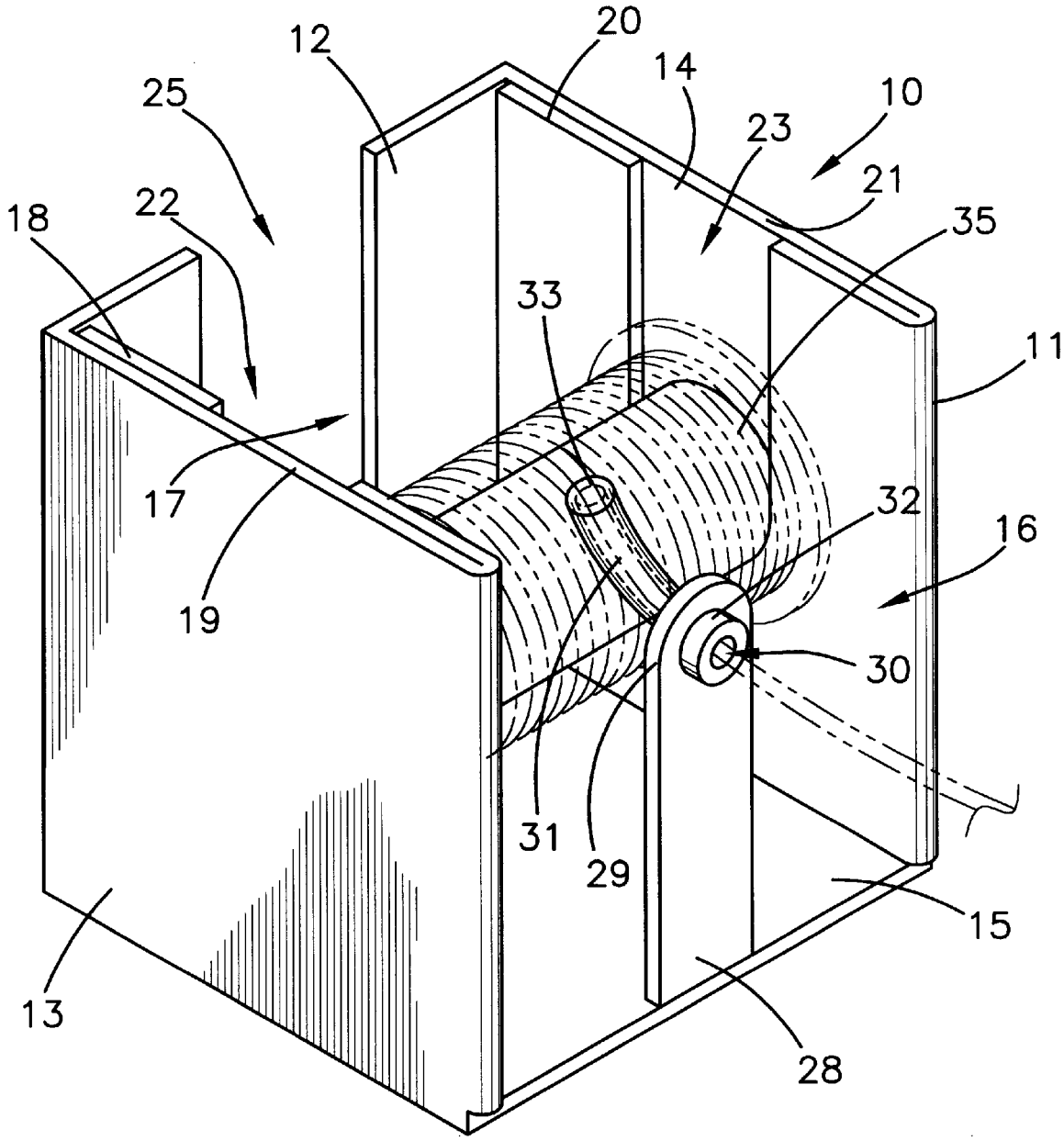
FIG. 1 is a perspective view of a new solder support and dispensing device according to the present invention.
Figure 2:
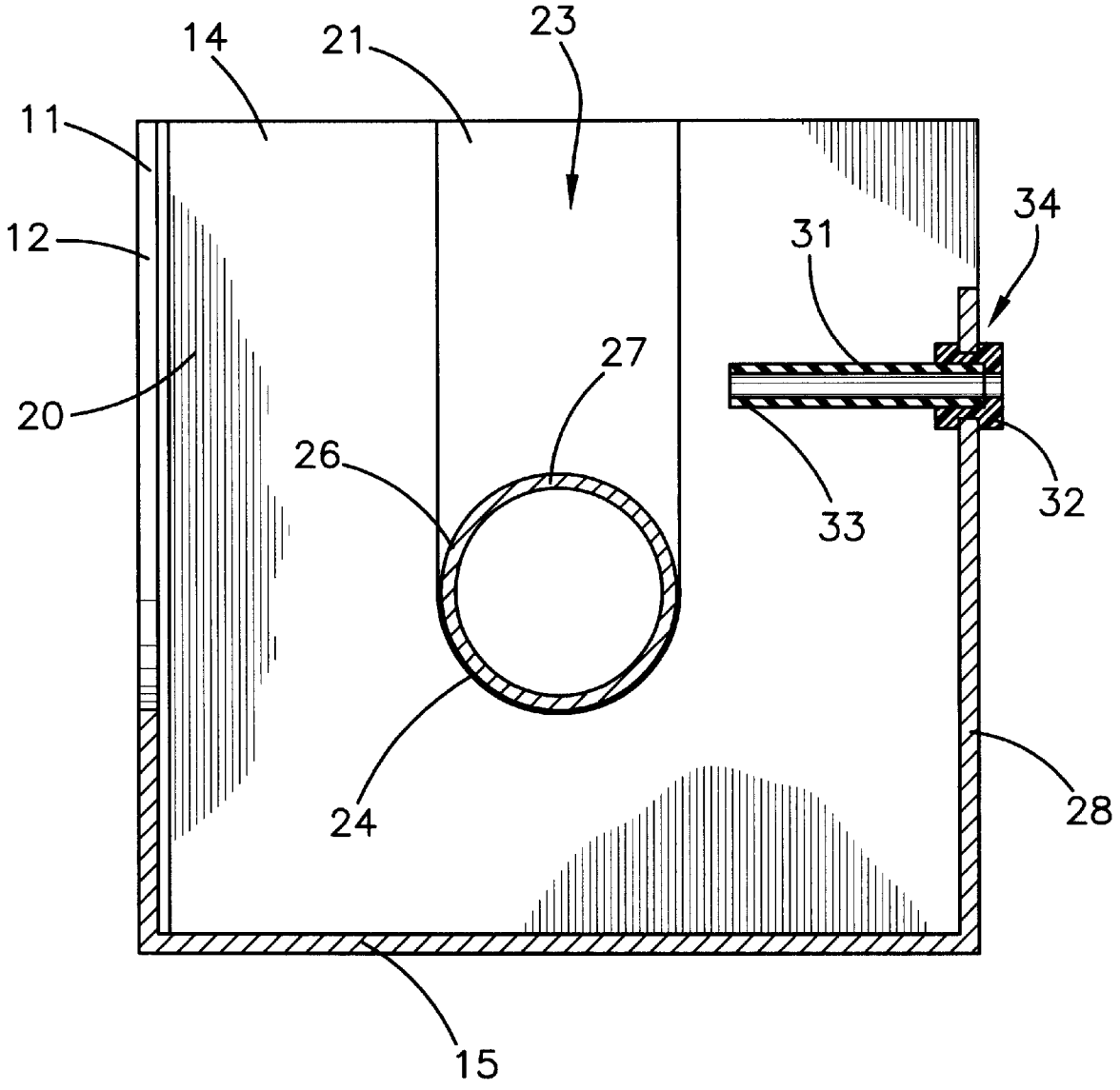
FIG. 2 is a cross-sectional view of the present invention.

With reference now to the drawings, and in particular to FIGS. 1 through 2 thereof, a new solder support and dispensing device embodying the principles and concepts of the present invention and generally designated by the reference numeral 10 will be described.

As best illustrated in FIGS. 1 through 2, the solder support and dispensing device 10 generally comprises a base member 11 having an open top 17, a first end wall 12, side walls 13,14, a bottom wall 15, and an open second end 16. Each of the side walls 13,14 of the base member 11 includes an inner wall member 18,20 and an outer wall member 19,21. Each of the inner wall members 18,20 has a longitudinal slot 22,23 extending from and through a top edge thereof and extending to essentially an intermediate portion of the inner wall member 18,20. The first end wall 12 of the base member 11 has a slot 25 extending from and through a top edge thereof and extending to essentially an intermediate portion thereof with the base member 11 being approximately 3½ inches in height, approximately 3½ inches in width, and approximately 3½ inches in length.

A spool support member 26 is removably suspended within the base member 11 for supporting a spool 35 carrying continuous solder. The spool support member 26 has ends 27 each of which is removably received in a respective longitudinal slot 22,23. The spool support member 26 is suspended above the bottom wall 15 of the base member 11. Each of the longitudinal slots 22,23 has a semi-circular bottom end 24 which is adapted to support a respective end 27 of the spool support member 26. The spool support member 26 is essentially an elongate cylindrical member with the spool support member being approximately 3½ inches in length and approximately 1 inch in diameter.

A solder feeding member 28 is securely and conventionally attached and welded to the bottom wall 15 and extends upwardly therefrom and is disposed at the open second end 16 of the base member 11. The solder feeding member 28 has a first end 29 and also has a hole 30 extending therethrough near the first end 29 thereof with the solder feeding member 28 being essentially disposed intermediate of the side walls 13,14 and being essentially an elongate plate-like member 28 which extends upwardly relatively between the intermediate portions and the top edges of the side walls 13,14. The solder feeding member 28 is approximately 2 inches in height and approximately ½ inches wide. The solder support and dispensing device 10 also includes a flexible tubular solder guide member 31 having an open first end and an enlarge first end portion 32 being securely and conventionally extending through the hole 30 in the solder feeding member 28. The tubular solder guide member 31 also has an open second end 33 which is adapted to receive solder therethrough with the tubular solder guide member 31 being adapted to prevent jamming of the solder during the dispensing thereof. Further, the flexible tubular solder guide member 31 is adapted to extend to a top of the spool 35 carrying the solder. In addition, the enlarged first end portion 32 of the flexible tubular solder guide member 31 includes a groove 34 circumferentially-extending therein and being adapted to receive an edge of the hole 30 for securing the flexible tubular solder guide member 31 to the solder feeding member 28.

In use, the user mounts a spool 35 of solder about the spool support member 26 which is mounted within the longitudinal slots 22,23 of the inner wall members 18,20 of the base member 11 and the end of the solder is extended through the flexible tubular solder guide member 31 and through the hole 30 in the solder feeding member 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A solder support and dispensing device comprising:

a base member having an open top, a first end wall, side walls, a bottom wall, and an open second end;

a spool support member being removably suspended within said base member for supporting a spool carrying continuous solder;

a solder feeding member being securely attached to said bottom wall and extending upwardly therefrom and being disposed at said open second end of said base member, said solder feeding member having a first end and also having a hole extending therethrough near said first end thereof; and a flexible tubular solder guide member having an open first end and an enlarged end portion being securely extending through said hole in said solder feeding member, said tubular solder guide member also having an open second end which is adapted to receive solder therethrough, said tubular solder guide member being adapted to prevent jamming of the solder during the dispensing thereof.

2. A solder support and dispensing device as described in claim 1, wherein each of said side walls of said base member includes an inner wall member and an outer wall member, each of said inner wall members having a longitudinal slot extending from and through a top edge thereof and extending to essentially an intermediate portion of said inner wall member.

3. A solder support and dispensing device as described in claim 2, wherein said spool support member has ends each of which is removably received in a respective said longitudinal slot, said spool support member being suspended above said bottom wall of said base member.

4. A solder support and dispensing device as described in claim 3, wherein each of said longitudinal slots has a semi-circular bottom end which is adapted to support a respective said spool support member.

5. A solder support and dispensing device as described in claim 4, wherein said solder feeding member is essentially disposed intermediate of said side walls and is essentially an elongate plate-like member which extends upwardly relatively between said intermediate portions and said top edges of said side walls.

6. A solder support and dispensing device as described in claim 5, wherein said flexible tubular solder guide member is adapted to extend to a top of the spool carrying the solder.

7. A solder support and dispensing device as described in claim 6, wherein said enlarged first end portion of said flexible tubular solder guide member includes a groove circumferentially-extending therein and being adapted to receive an edge of said hole for securing said flexible tubular solder guide member to said solder feeding member.

8. A solder support and dispensing device as described in claim 7, wherein said spool support member is essentially an elongate cylindrical member.

9. A solder support and dispensing device as described in claim 8, wherein said first end wall of said base member has a slot extending from and through a top edge thereof and extending to essentially an intermediate portion thereof.

10. A solder support and dispensing device comprising:

a base member having an open top, a first end wall, side walls, a bottom wall, and an open second end, each of said side walls of said base member including an inner wall member and an outer wall member, each of said inner wall members having a longitudinal slot extending from and through a top edge thereof and extending to essentially an intermediate portion of said inner wall member, said first end wall of said base member having a slot extending from and through a top edge thereof and extending to essentially an intermediate portion thereof, said base member being approximately 3½ inches in height, approximately 3½ inches in width, and approximately 3½ inches in length;

a spool support member being removably suspended within said base member, said spool support member having ends each of which is removably received in a respective said longitudinal slot, said spool support member being suspended above said bottom wall of said base member for supporting a spool carrying continuous solder, each of said longitudinal slots having a semi-circular bottom end which is adapted to support a respective said spool support member, said spool support member being essentially an elongate cylindrical member, said spool support member being approximately 3½ inches in length and approximately 1 inch in diameter;

a solder feeding member being securely attached to said bottom wall and extending upwardly therefrom and being disposed at said open second end of said base member, said solder feeding member having a first end and also having a hole extending therethrough near said first end thereof, said solder feeding member being essentially disposed intermediate of said side walls and being essentially an elongate plate-like member which extends upwardly relatively between said intermediate portions and said top edges of said side walls, said solder feeding member being approximately 2 inches in height and approximately ½ inches wide; and a flexible tubular solder guide member having an open first end and an enlarged end portion being securely extending through said hole in said solder feeding member, said tubular solder guide member also having an open second end which is adapted to receive solder therethrough, said tubular solder guide member being adapted to prevent jamming of the solder during the dispensing thereof, said flexible tubular solder guide member being adapted to extend to a top of the spool carrying the solder, said enlarged first end portion of said flexible tubular solder guide member includes a groove circumferentially-extending therein and being adapted to receive an edge of said hole for securing said flexible tubular solder guide member to said solder feeding member.

* * * * *